US008360114B2

(12) United States Patent
Clark

(10) Patent No.: US 8,360,114 B2
(45) Date of Patent: Jan. 29, 2013

(54) APPARATUS AND METHOD FOR FILING A SYRINGE

(76) Inventor: Niles Clark, Milton, WV (US)

( * ) Notice: Subject to any disclaimer, the term of this patent is extended or adjusted under 35 U.S.C. 154(b) by 681 days.

(21) Appl. No.: 12/027,865

(22) Filed: Feb. 7, 2008

(65) Prior Publication Data

US 2008/0185069 A1 Aug. 7, 2008

Related U.S. Application Data

(63) Continuation-in-part of application No. 10/691,695, filed on Oct. 23, 2003, now abandoned.

(51) Int. Cl.
*B65B 3/04* (2006.01)

(52) U.S. Cl. ..... 141/27; 141/97; 141/330; 604/414

(58) Field of Classification Search ..... 141/27, 141/97, 94, 329, 330; 604/414, 415
See application file for complete search history.

(56) References Cited

U.S. PATENT DOCUMENTS 5,247,972 A 9/1993 Tetreault
5,542,760 A 8/1996 Chanoch et al.
5,669,502 A * 9/1997 Ong et al. ..... 604/403
5,894,870 A * 4/1999 Maxwell ..... 141/27
6,364,866 B1 * 4/2002 Furr et al. ..... 604/414
6,439,276 B1 8/2002 Wood et al.
6,497,697 B1 * 12/2002 Cohn ..... 604/414
6,581,648 B1 * 6/2003 Zolentroff et al. ..... 141/27
7,963,954 B2 * 6/2011 Kavazov ..... 604/403
2004/0112457 A1 * 6/2004 Norton et al. ..... 141/26

* cited by examiner

*Primary Examiner* — Gregory Huson
*Assistant Examiner* — Nicolas A Arnett
(74) *Attorney, Agent, or Firm* — Waters Law Group, PLLC; Robert R. Waters; Brian W. Foxworthy

(57) ABSTRACT

An apparatus for assisting a user in loading a syringe with medication from a medicinal vial comprising an elongated guide having a syringe well and a vial well, the syringe well having a syringe well opening along a surface of the guide. A syringe guide member inserted into and removable from the syringe well through the syringe well opening, the syringe guide member having a bore for receiving and guiding the syringe. The vial well receiving the vial. The guide has a wall separating the syringe well and the vial well, the wall having an aperture formed therethrough providing communication between one end of the bore and the vial, the recess mutually adjacent with the wall. The guide includes a displaceable cover enclosing the syringe well and the vial well. The guide may also include a magnifying element coupled to the cover.

16 Claims, 16 Drawing Sheets

APPARATUS AND METHOD FOR FILING A SYRINGE

RELATED U.S. APPLICATION DATA

This application is a continuation-in-part of prior application Ser. No. 10/691,695, filed on Oct. 23, 2003 now abandoned, and published as Pub. No. US 2005/0087256 A1 on Apr. 28, 2005.

FIELD OF THE INVENTION

This application discloses embodiments and recites claims generally related to an apparatus and method that aids in the alignment and filling of a hypodermic needle and syringe, the apparatus and method particularly suitable for use by individuals that self-administer prescribed medication but may have a variety of visual or musco-skeletal impairments.

BACKGROUND OF THE INVENTION

Self-administering medication via hypodermic needle and syringe has advantages and disadvantages, respectively. Self-administration of medication allows the user or individual to avoid visiting the doctor at a hospital or office, thereby saving the user or individual time and expenses, as well as reducing exposure to illness(es) that may be passed between patients in a waiting area. Self-administration also permits the user or individual ready access to the medication in case of an emergency, such as with a diabetic that may be in need of an immediate dose of insulin. Conversely, many individuals are not confident in the handling and usage of hypodermic needle and syringe devices. This lack of confidence is heightened if an injury or impairment occurs to the user, including the loss of vision and/or hand-eye coordination or general motor skills.

Several apparatuses and/or methods have been proposed to improve the use of hypodermic needle and syringe devices, including various holders and stabilizers, to accommodate the impairment(s) an individual may suffer from—poor vision; hand tremors; general nervousness or anxiety from the sight or use of needles. However, the various improvements previously presented fail to disclose the embodiments disclosed and claimed herein, including the constituent elements and the arrangement of elements disclosed and contemplated. As such, the embodiments disclosed and claimed herein provide an unanticipated and nonobvious improvement, and fulfill a need in providing confidence to individuals that may self-administer medication or aid in the self-administration of medication to others (such as children or other elderly or impaired individuals). Applicant is unaware of any apparatus, device, method or disclosure that describes the embodiments disclosed and claimed herein.

SUMMARY OF THE INVENTION

In one embodiment, n apparatus for assisting a user in loading a syringe with medication from a medicinal vial is disclosed, the apparatus comprising a guide comprising a syringe bore and a vial well, the exterior of the guide having magnification, a wall separating the syringe bore and the vial well, the syringe bore for receiving and guiding the syringe into communication with the vial, the vial well receiving the vial, the vial well having a recess supporting the neck of the vial, the wall having an aperture formed therethrough providing communication between one end of the bore and the vial; and a displaceable cover enclosing the vial well.

In another embodiment, an apparatus for assisting a user in loading a syringe with medication from a medicinal vial is disclosed, the apparatus comprising an elongated guide having a syringe well and a vial well, a syringe guide member inserted into and removable from the syringe well, the syringe guide member having a bore for receiving and guiding the syringe, the vial well receiving the vial, the vial well having a recess supporting the neck of the vial, a wall separating the syringe well and the vial well, the wall having an aperture formed therethrough providing communication between one end of the bore and the vial, a displaceable cover enclosing the syringe well and the vial well, and a magnifying element coupled to the cover, the lens magnifying the contents of the syringe well and the vial well.

In another embodiment, an apparatus for assisting a user in loading a syringe with medication from a medicinal vial is disclosed, the apparatus comprising an elongated guide having a syringe well and a vial well, the syringe well having a syringe well opening along a surface of the guide, a syringe guide member inserted into and removable from the syringe well through the syringe well opening, the syringe guide member having a bore for receiving and guiding the syringe, the vial well having a vial well opening along a anterior surface of the guide and receiving the vial through the vial well opening, the vial well having a recess supporting the neck of the vial, the vial well having a removable panel and a plurality of slits, the panel removable from one of the slits for placement within one of the other slits, the panel supporting the base of the vial when placed within the recess, a wall separating the syringe well and the vial well, the wall having an aperture formed therethrough providing communication between one end of the bore and the vial, the recess mutually adjacent with the wall, the recess aligning the neck of the vial with the aperture of the wall, a displaceable cover enclosing the syringe well and the vial well, the cover having a saddle disposed on the interior side thereof, and a magnifying element coupled to the cover, the lens magnifying the contents of the syringe well and the vial well when the cover is placed over the syringe well and the vial well.

The embodiments may include a bore having a funnel-shape, tapered from a wider end to a narrow end, the narrow end corresponding with the aperture formed in the wall. The embodiments may also include retention means for immobilizing the syringe barrel during use of the guide. It is also envisioned that the magnifying element may be removable from cover for cleaning or replacement, if required.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way. It is intended that the application is defined by the claims.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE PREFERRED EMBODIMENT

The detailed description below is for preferred embodiments and is intended to explain the current invention. It is to be understood that a variety of other arrangements are also possible without departing from the spirit and scope of the invention.

Figure 1:
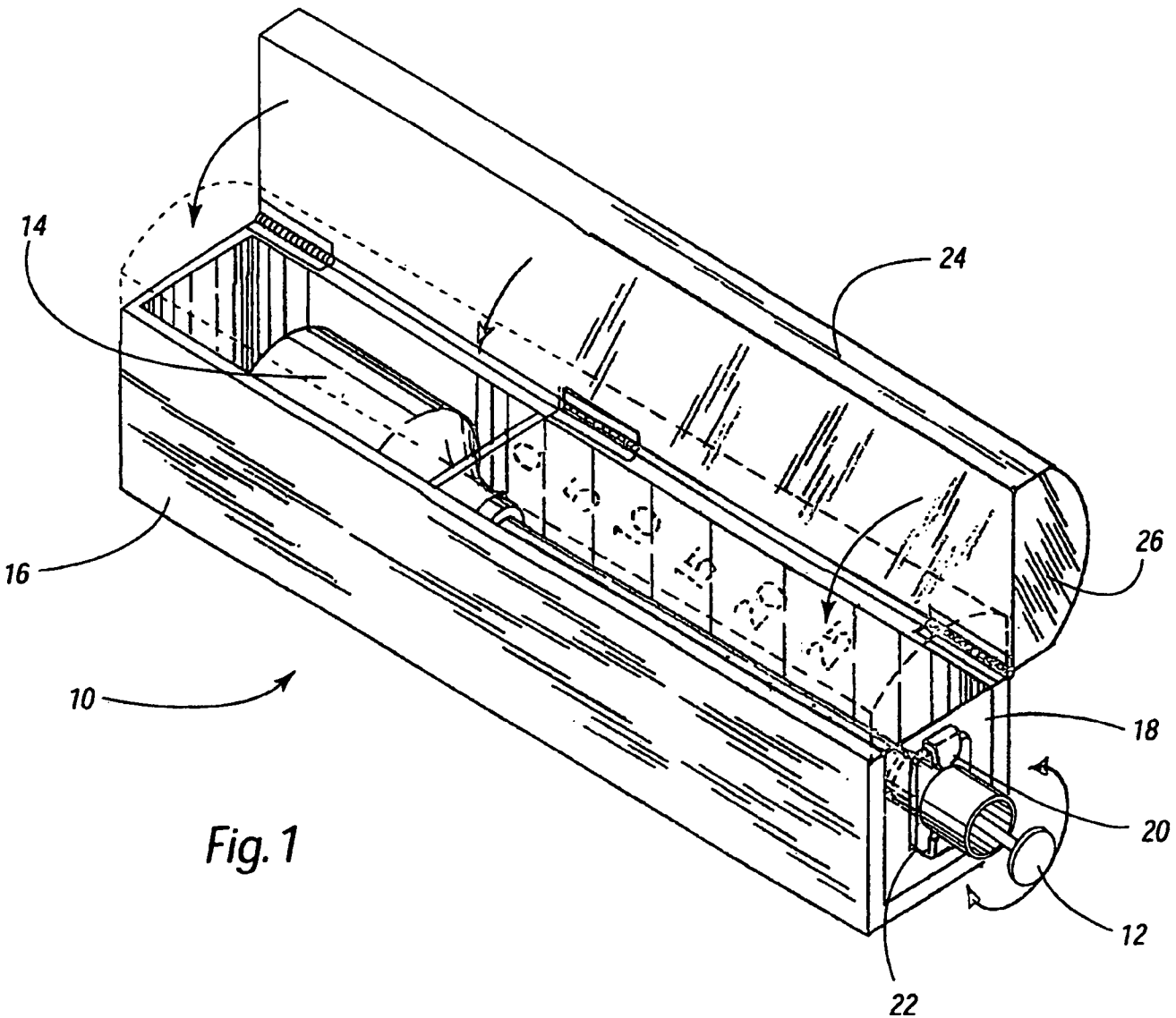
FIG. 1 illustrates the preferred embodiment of a syringe loading article with lid containing a medicine vial and changeable guide.

The following discussion illustrates only some of the possible configurations claimed in this invention and should not be interpreted as limiting the scope of the claims. FIG. 1 shows the preferred embodiment of the syringe loading system (10) which assists in guiding a syringe (12) into a medicine vial (14). The syringe guide (10) consist of three major components, a sectioned box (16), a changeable syringe guide member (18), and a lid (24). The changeable syringe guide member (18) has an aperture through it which is slightly larger than the barrel diameter of a syringe (12). A syringe (12) is inserted through this aperture to accurately guide it to a medicine vial (14). The changeable syringe guide member (18) and the lid (24) are made of suitable material to allow the syringe (12) to be observed through the lid (24) and changeable syringe guide member (18) with the lid (24) having its surface (26) shaped so as to provide a magnifying effect so that the readings on the syringe (12) are more easily seen. This magnifying effect in the lid (24) would also provide better viewing of the vial (14). On the changeable syringe guide member (18) are syringe retainers (20) which keep the syringe (12) engaged in the vial (14) while filling the syringe (12).

To use the syringe guide (10), a person would select a changeable syringe guide member (18) having the correct diameter and length to fit the syringe (12) to be filled, and place the selected changeable syringe guide member (18) in the sectioned box (16). The medicine vial (14) would then be placed in position in the sectioned box (16) and the lid (24) closed, retaining both the vial (14) and changeable syringe guide member (18). A volume of air equal to the desired amount of medicine would be drawn into the syringe (12) and the syringe (12) inserted through the changeable syringe guide member (18) into communication with the vial (14). Turning the syringe (12) would engage tabs (22) on the syringe (12) into the syringe retainers (20). The air in the syringe (12) would then be expelled into the vial (14) and medicine drawn into the syringe (12) while reading the volume through the magnifying surface (26) of the lid (24).

There are other possible features of this embodiment. One would be a funnel shaped portion at the front of the aperture in the changeable syringe guide member (18) to allow easier insertion of the syringe (12). Another option is interlocking tabs in the changeable syringe guide member (18) and the sectioned box (16) which would insure that the changeable syringe guide member (18) is inserted into the sectioned box (16) in the correct orientation. A third optional feature is syringe retainers located on the lid (24). This would require closing the lid (24) after the syringe (12) is inserted into the changeable syringe guide member (18). The syringe retainers mounted on the lid (24) would serve the function of the retainers (20) without requiring the turning of the syringe (12) to engage. There are also various common methods in which an object may be mounted on a horizontal or vertical fixed surface such as a wall or table and these methods could be used with the present invention.

Figure 2:
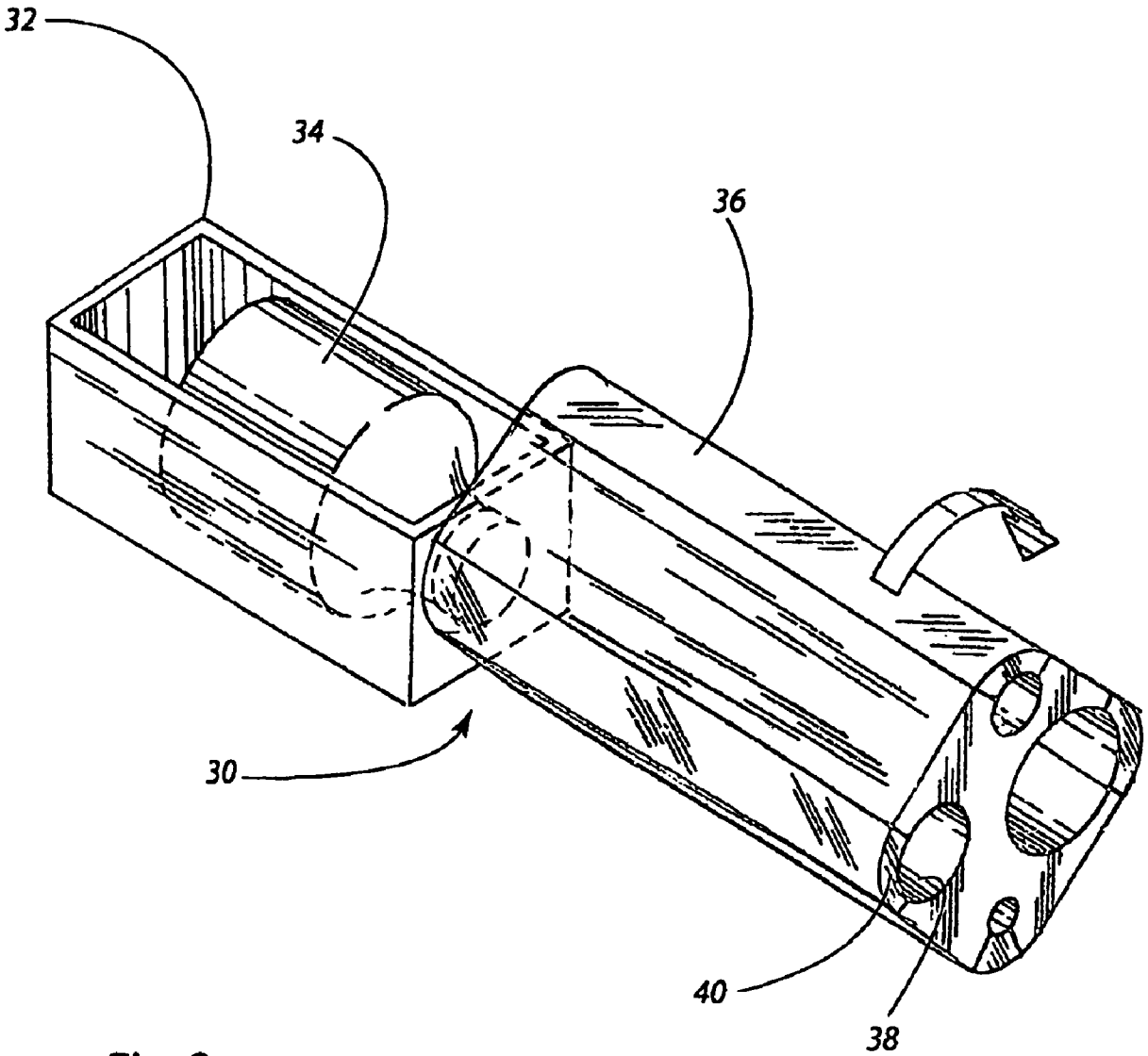
FIG. 2 shows a multiple aperture guide pivotably associated with the holder containing a medicine vial.
Figure 3:
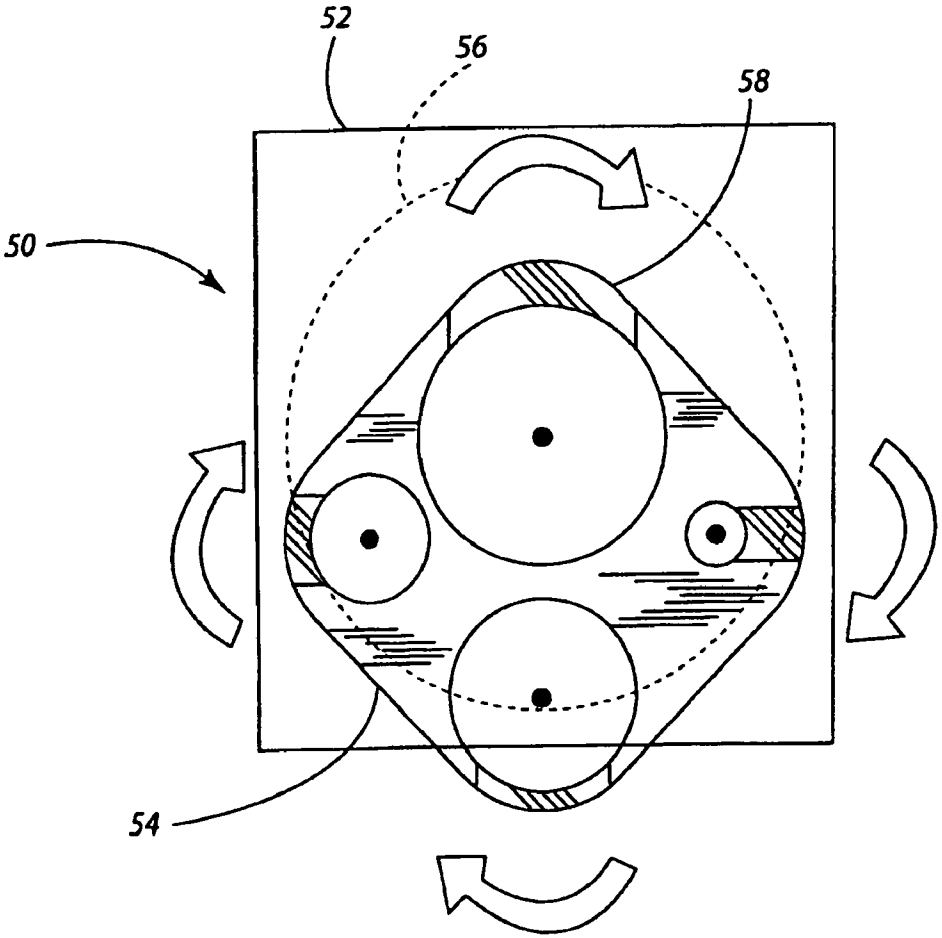
FIG. 3 is an end view of the embodiment shown in FIG. 2.

Another claimed embodiment for a syringe loading system (30) is shown in FIG. 2. The apparatus (30) has a vial box (32) for holding a vial (34) and a revolving syringe guide member (36) rotatably attached to the vial box (32). The revolving syringe guide member (36) has multiple apertures (38) of various diameters to fit syringes of standard sizes. The revolving syringe guide member (36) is made of a material that allows a syringe to be viewed while it is inserted through an aperture (38) and is in communication with a medicine vial (34) and the surface (40) of the revolving syringe guide member (36) near the apertures (38) is shaped so as to provide a magnifying effect to enhance the viewing of a syringe. FIG. 3 shows an end view of this embodiment, the dotted circle (56) showing the outline of a vial placed in the vial box (52). The black dots in the apertures in the revolving syringe guide member (54) show how the needles for various size syringes would align with the vial (56). Each aperture has a magnifying curve (58) associated with it in the surface of the revolving syringe guide member (54).

There are additional features which may be associated with the syringe guide (30) of FIG. 2. The revolving syringe guide member (36) may have retainers associated with each aperture (38) and each aperture (38) may have a funnel shaped opening to facilitate location of the aperture with a syringe (not shown in drawing). Also the exposed end of the revolving syringe guide member (36) may be irregular to accommodate different standard lengths associated with the different standard diameters of syringes (not shown in fringes).

Figure 4:
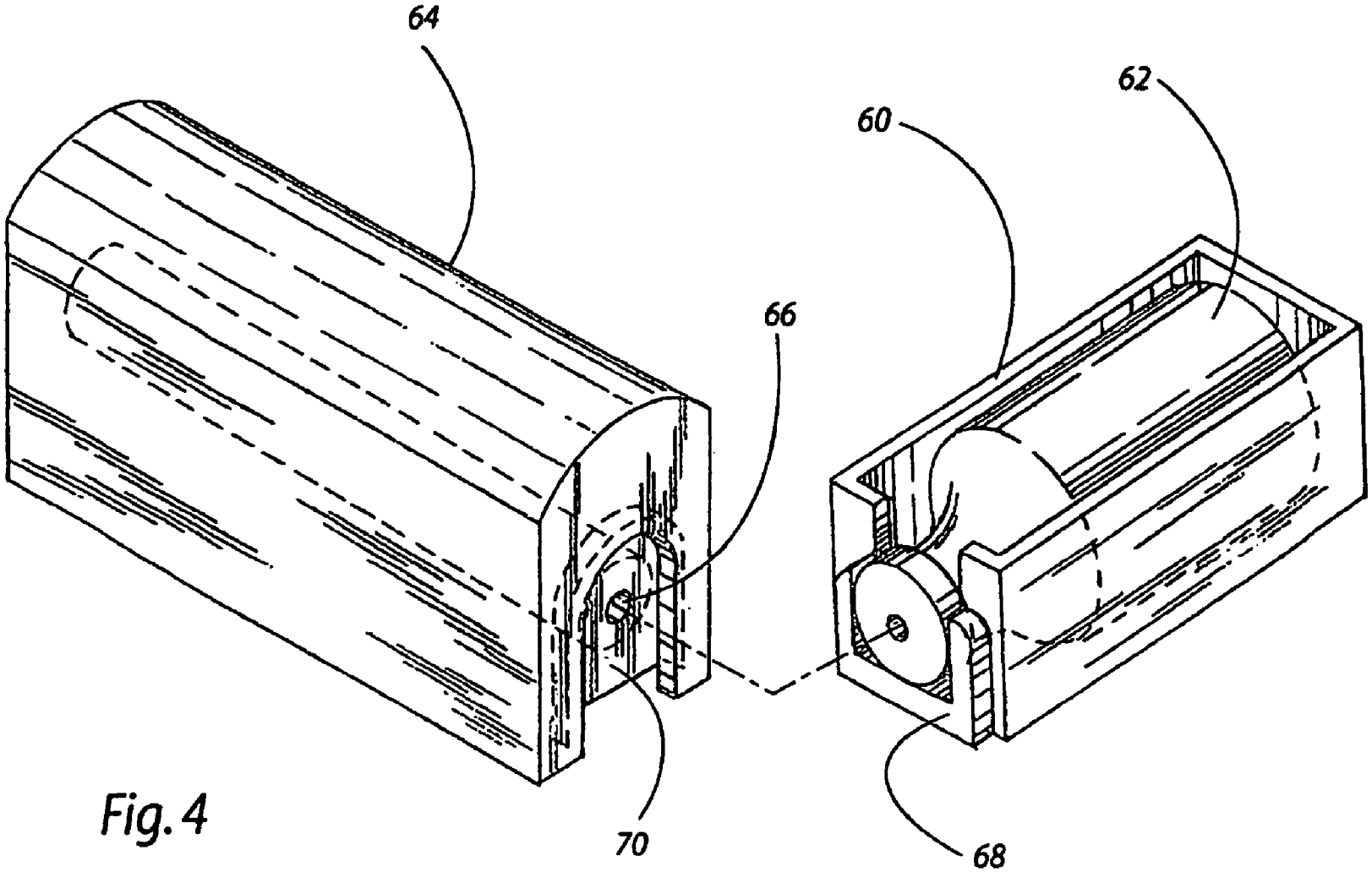
FIG. 4 shows an interlocking syringe guide and vial box.

FIG. 4 illustrates an embodiment wherein a vial box (60) holds a medicine vial (62) with the vial box (62) being able to interlock with a syringe guide (64). An external interlocking member (68) on the vial box (60) slides into the recess (70) of the syringe guide (64). An aperture through the syringe guide (64) accommodates a syringe and has an opening (66) which allows a syringe needle to penetrate the medicine vial (62). The interlocking association of the vial box (60) and the syringe guide (64) serve to retain the medicine vial (62). Different syringe guides (64) would have different diameter apertures and different lengths to accommodate different size syringes. This embodiment can incorporate many elements previously discussed such as syringe retainers, funnel shaped beginnings in the guiding apertures and magnifying shapes and materials for the guide and the box.

Figure 6:
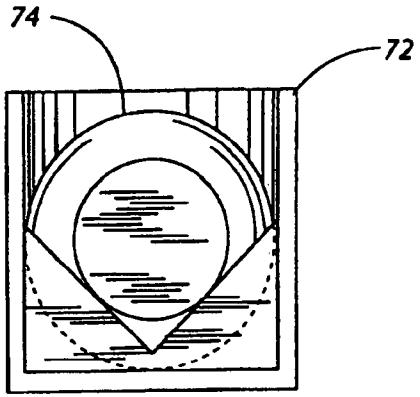
FIG. 6 is an end view showing the alignment of the syringe with the vial.
Figure 7:
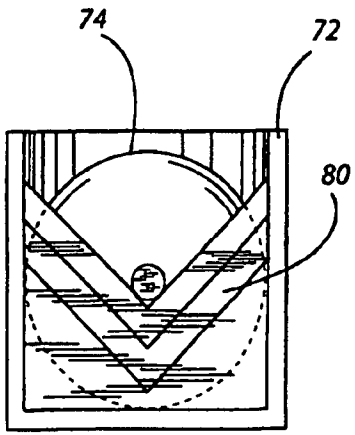
FIG. 7 shows the stacking of "V" groove guides to accommodate different syringes.
Figure 5:
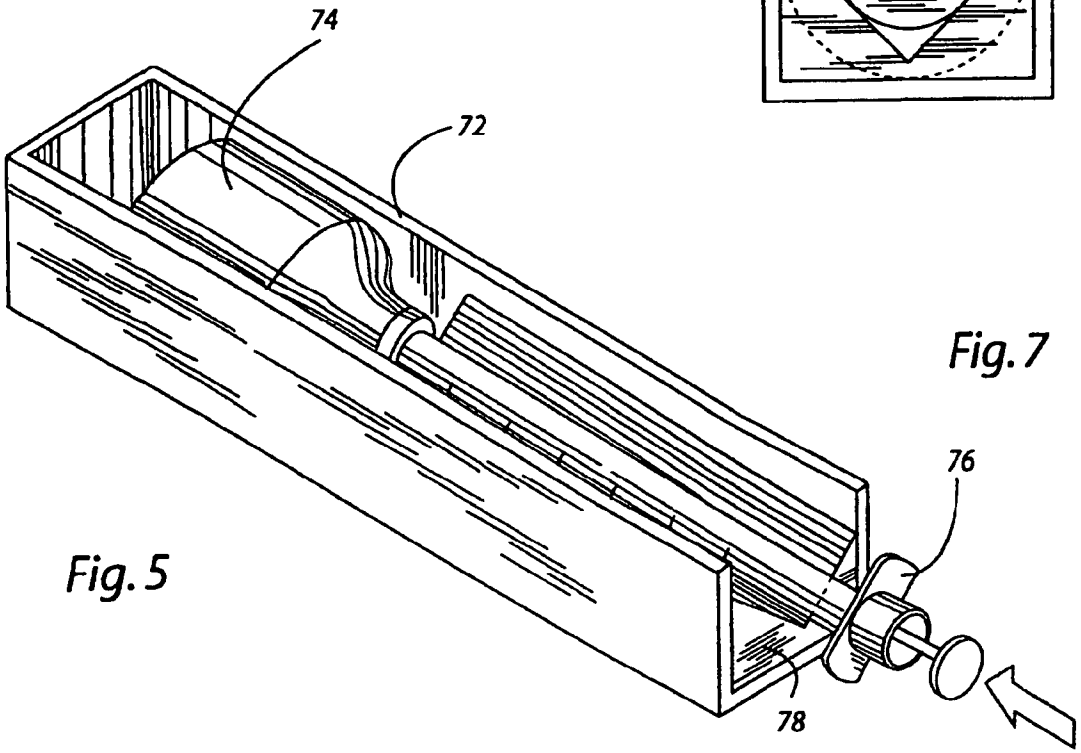
FIG. 5 shows an embodiment similar to the preferred embodiment, but the guide uses "V" grooves instead of aperture.
Figure 8:
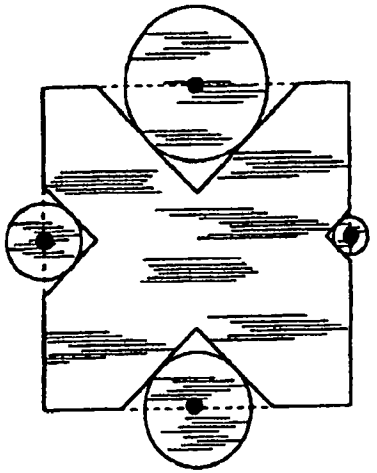
FIGS. 8-12 show an embodiment where "V" grooves of differing depths are located on the sides of a repositionable guide.

FIGS. 5, 6 & 7 show an embodiment similar to the preferred embodiment wherein a sectioned box (72) holds a medicine vial (74) to which a syringe (76) is guided by changeable syringe guides (78). The changeable syringe guides (78) have V-shaped channels in their surface which align syringes (76) of various diameters with the medicine vial (74). FIGS. 6 & 7 are end views wherein the cylinders represent the barrels of different size syringes being aligned with the medicine vial (74). The guides (78) may also be stackable as shown in FIG. 7 by the guide (80). This embodiment can also incorporate previously mentioned features such as a magnifying lid and syringe retainers.

Figure 9:
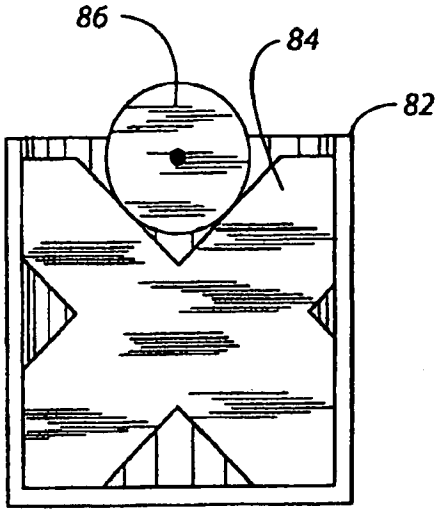
Figure 10:
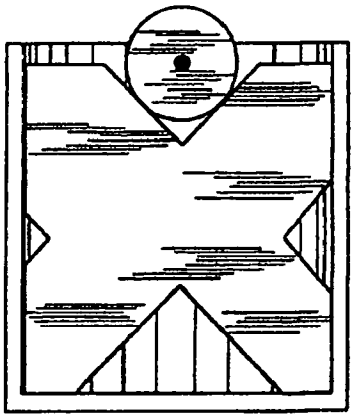
Figure 11:
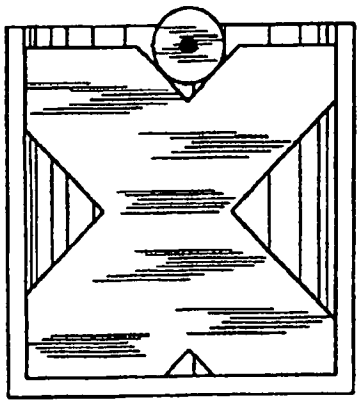
Figure 12:
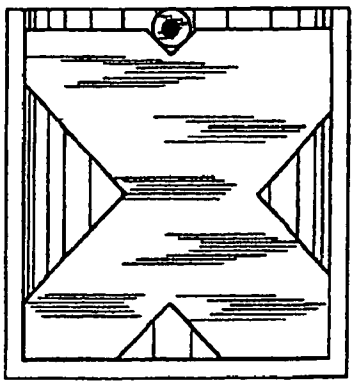

FIGS. 8-12 show end views of yet another embodiment. FIG. 9 shows the end view of a changeable syringe guide (84) with V-grooves along its sides. The changeable syringe guide (84) fits into a segmented box (82) and aligns different size syringes (86) depending on the orientation of the syringe guide (86). This embodiment can incorporate many of the optional features previously discussed as well.

Figure 13:
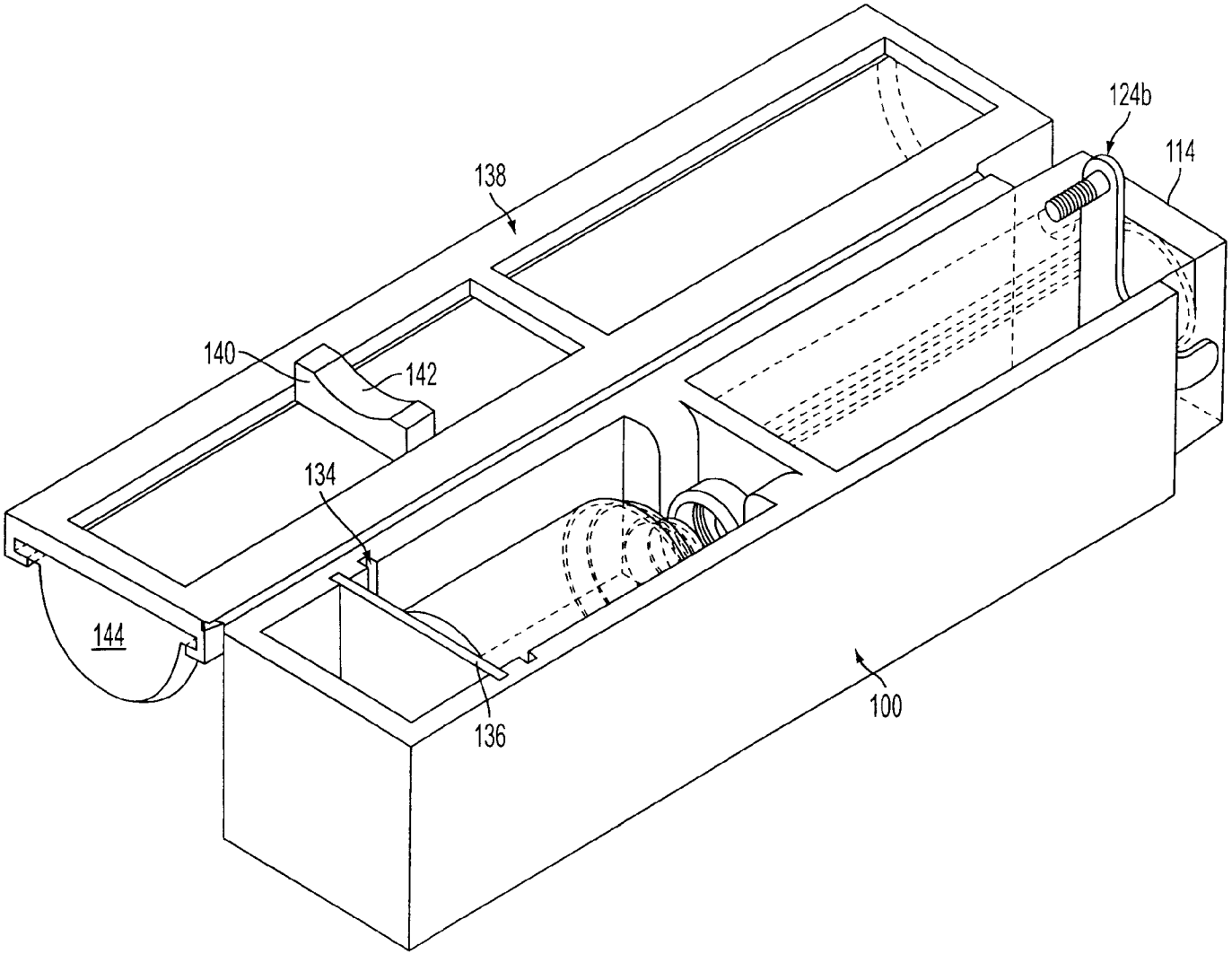
FIG. 13 is a perspective view of one embodiment of the guide having a syringe well, a syringe guide member slidably insertable therein, a vial well, and a cover or door enclosing the wells.
Figure 14:
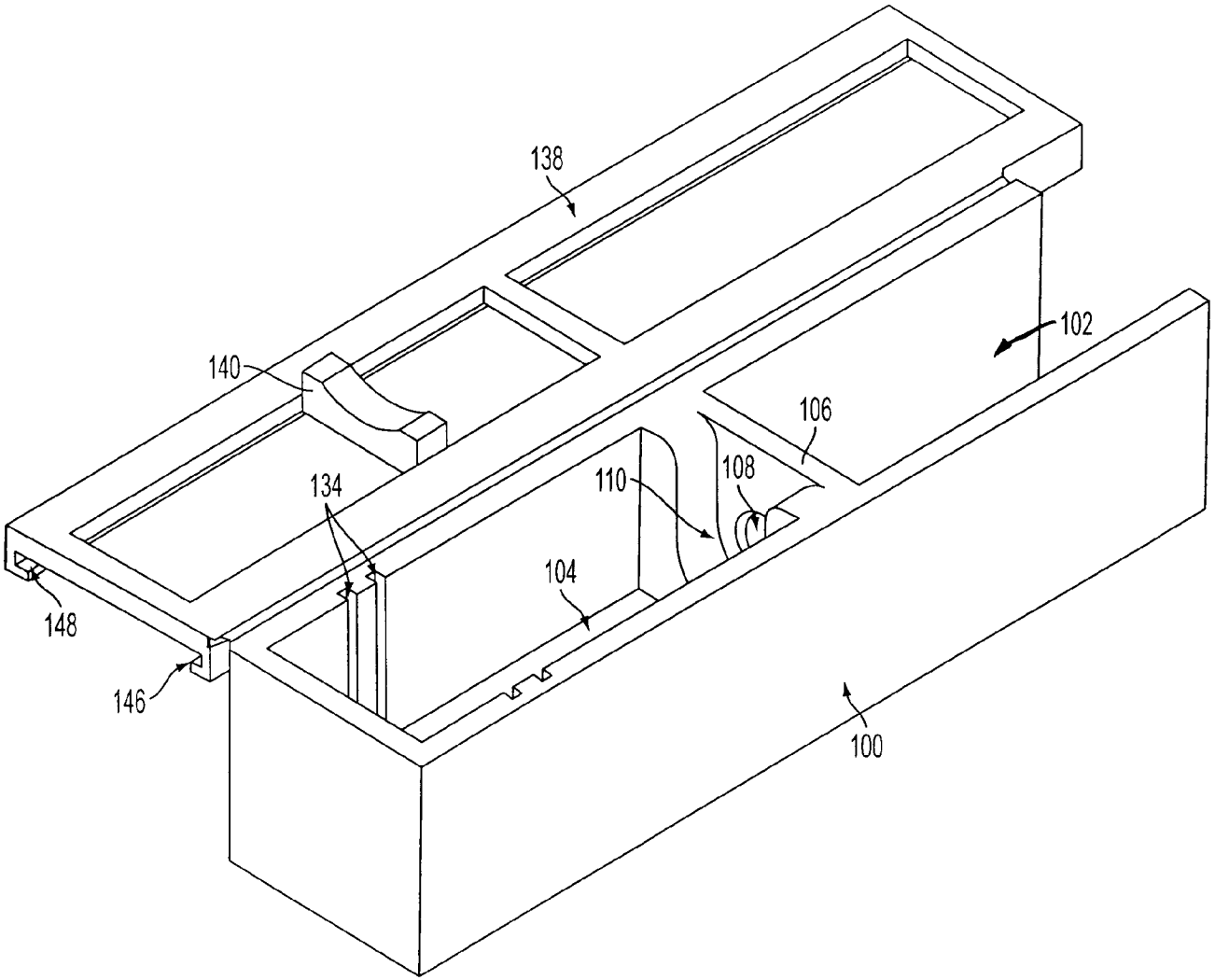
FIG. 14 is a perspective view of the embodiment depicted in FIG. 13.
Figure 15:
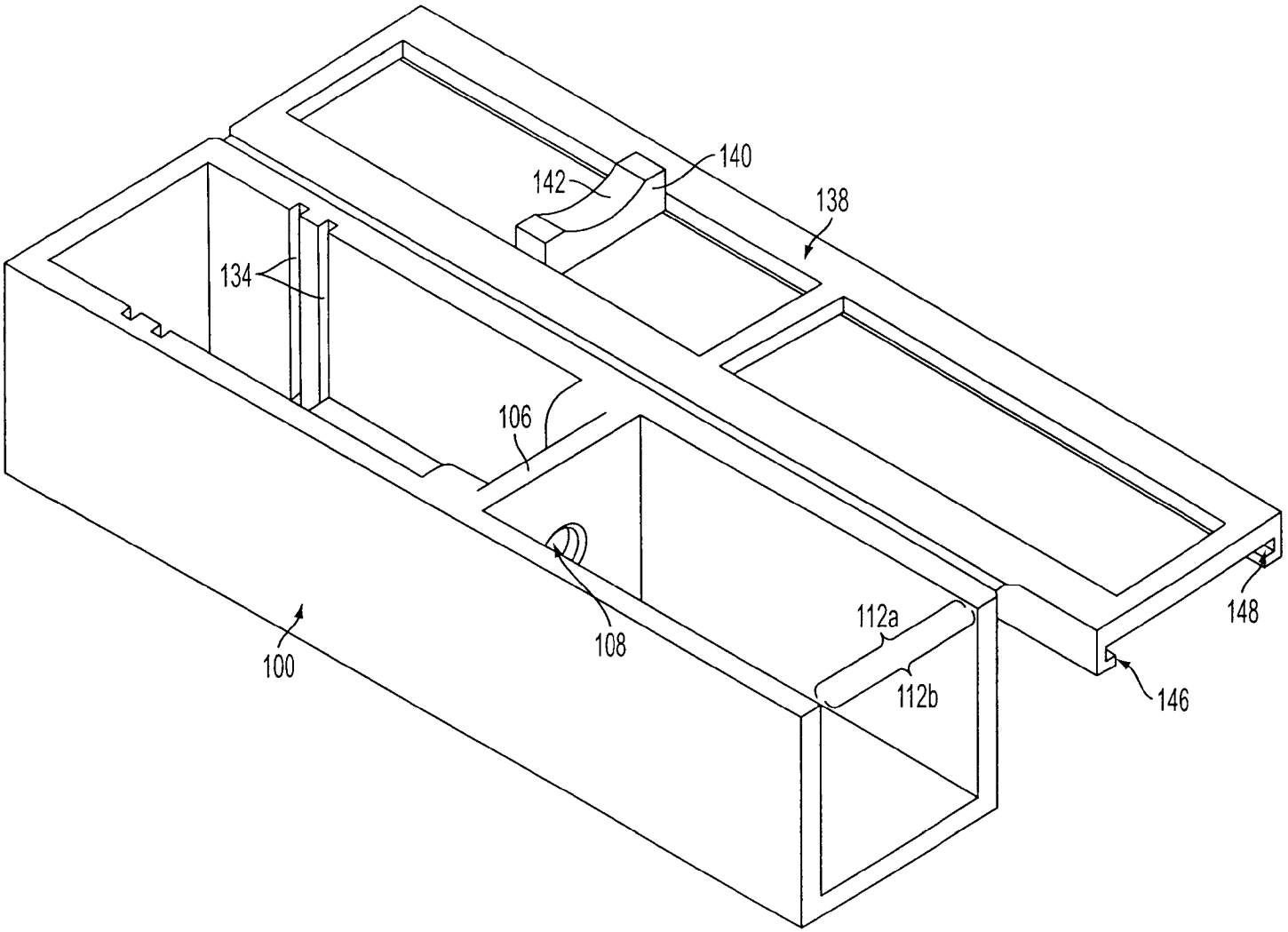
FIG. 15 is a perspective view of the embodiment depicted in FIG. 14 view from the opposing end.

Referring now to FIGS. 13-23, additional embodiments are disclosed. In FIGS. 13, 14 and 15, respectively, a guide 100 is depicted having a syringe well 102 and a vial well 104, the wells 102 and 104 generally separated or segregated by a wall 106 disposed therebetween. The wall 106 has an aperture 108 permitting fluid communication between the wells 102 and 104. On the vial well side of the wall 106, a recess 110 is formed to receive and support the neck of a vial. The recess 110 may be integral to the wall 106, so that the recess 110 is cut from the wall 106 during fabrication. It is also envisioned that the recess 110 may be a separate element (a recess cut from a blank having similar width and height as the wall 106) installed during fabrication in such a way that the wall 106 and the recess 110 are mutually adjacent to one another. The recess 110 properly positions and aligns the neck of the vial so that the opening in the neck (and the membrane covering the neck) are substantially coextensive to the aperture 108. As shall be understood by the description below, the alignment of the neck, its opening and the aperture 108 generally align with the bore that guides the syringe so that the needle is easily inserted into and through the membrane for extracting the medication therefrom.

As depicted in FIG. 15, the syringe well 102 has an opening (syringe well opening) 112*a* or 112*b*, respectively. As indicated by the lines, the opening may be positioned at an anterior surface of the guide, 112*a*, or at a top surface of the guide 112*b*. A syringe guide member 114 may be inserted into the syringe well 102 through either opening 112*a* or 112*b*.

Figure 16:
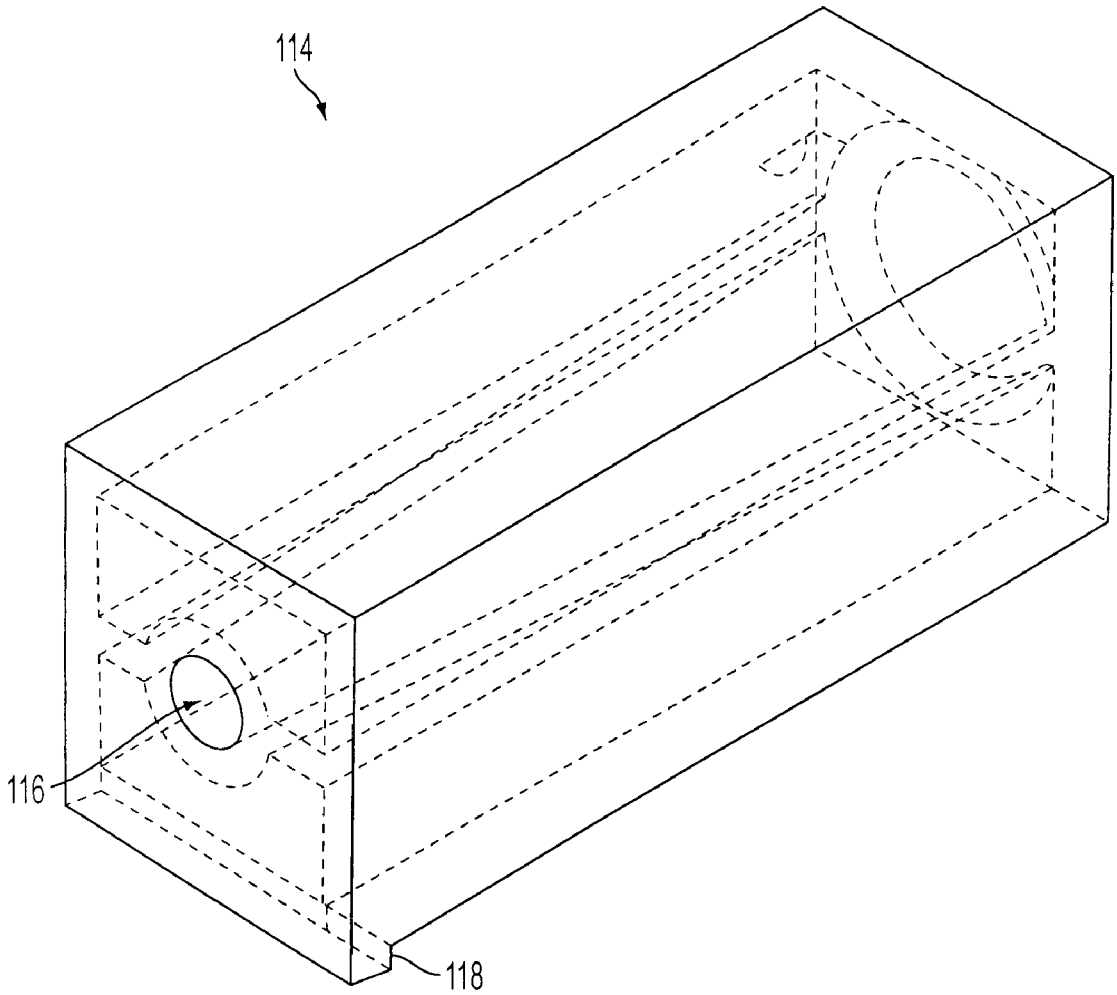
FIG. 16 is a perspective view of a syringe guide member slidably insertable into the syringe well of the embodiment depicted in FIG. 13 through FIG. 15.
Figure 17:
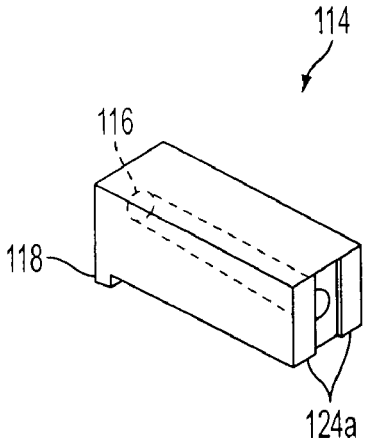
FIG. 17 is a perspective view of the guide member of FIG. 16.

The syringe guide member 114 comprises a body generally envisioned to form the substantial complement of the volume or space formed within the syringe well 102, though the syringe well 102 and member 114 are not limited to any specific geometric forms and are envisioned to include a cylindrical form and irregular or distorted polygons, including the irregular hexahedron depicted in FIG. 16. The member 114 comprises a bore 116 coaxial to an imaginary axis traversing the elongated length of the member 114. The bore 116 terminates in openings at opposing ends of the member 114. The end of the member 114 adjacently placed to the wall 106 is positioned so that the opening of the bore 116 is aligned with the aperture 108 and the neck and membrane of the vial. The bore 116 may comprise a funnel-shape or taper, so that the end utilized for entry of the needle and syringe has a wider cross-sectional diameter than the opposing end (that is adjacent to the aperture 108 and neck of the vial). Generally, the bore 116 functions as a guide in directing the needle and syringe into communication with the aperture 108 and ultimately the neck of the vial, thereby facilitating the extraction of medication from the vial.

The member 114 may comprise means for retaining and immobilizing the syringe in a fixed position during withdrawal of the syringe plunger. In one embodiment, retention means comprises a pair of wings 124*a*, wherein each one of the wings is spaced-apart from an end of the syringe guide member 114 forming a void 126, the void 126 receiving and retaining the syringe flange therein. In another embodiment, retention means comprises an arm 124*b* secured to the syringe guide member 114 via attachment means and rotatable through 360 degrees of rotation. After the syringe is placed into the bore 116, the arm 124*b* is rotated and urged so as to engage the syringe barrel. In this manner, the arm 124*b* impinges the syringe barrel within the walls of the bore 116 and immobilizes movement thereof. It is envisioned that the arm 124*b* may further comprise an L-shape as depicted in the figures. It is further envisioned that the arm 124*b* may further comprise a fin 128 depending from the arm 124*b* along a plane perpendicular to the general plane of the arm 124*b*. The fin 128 may facilitate the user's ability to more easily rotate and engage the arm 124*b* with the syringe barrel for temporary impingement thereof.

It is envisioned that guide member 114 may comprise a variety of sizes and lengths, generally to accommodate the various sizes of syringe that are available for use, including 30 cc, 50 cc, 100 cc and 3 mL quantities. For the syringes, and dosages, that require the larger quantities, the guide member 114 may be elongated beyond the defined perimeter of the syringe well 102, thus generating an excess or overhang. In such an embodiment, the cover 138 and magnifying element 144 are elongated and configured to correspond with the overhang of the guide member 114, providing full enclosure and magnification of the syringe contents and indicium, indicia or print provided, and consistent with the disclosure of the cover 138 and magnifying element 144 provided in greater detail below.

Figure 18:
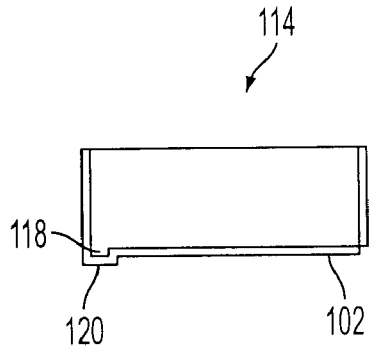
FIG. 18 is an exploded side-view of the guide member inserted into the syringe well, depicting the stud 118 and the channel 120, respectively.
Figure 19:
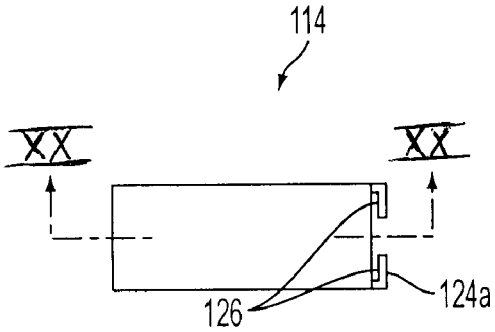
FIG. 19 is a top or bottom view of FIG. 17.
Figure 20:
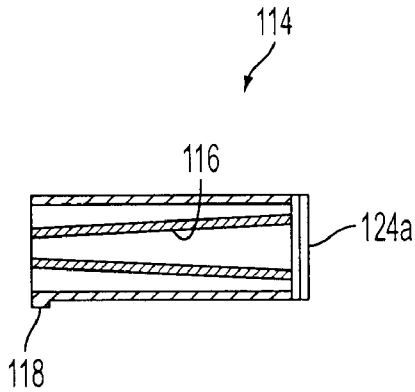
FIG. 20 is a cross-sectional view taken along line XX-XX from FIG. 19.
Figure 21:
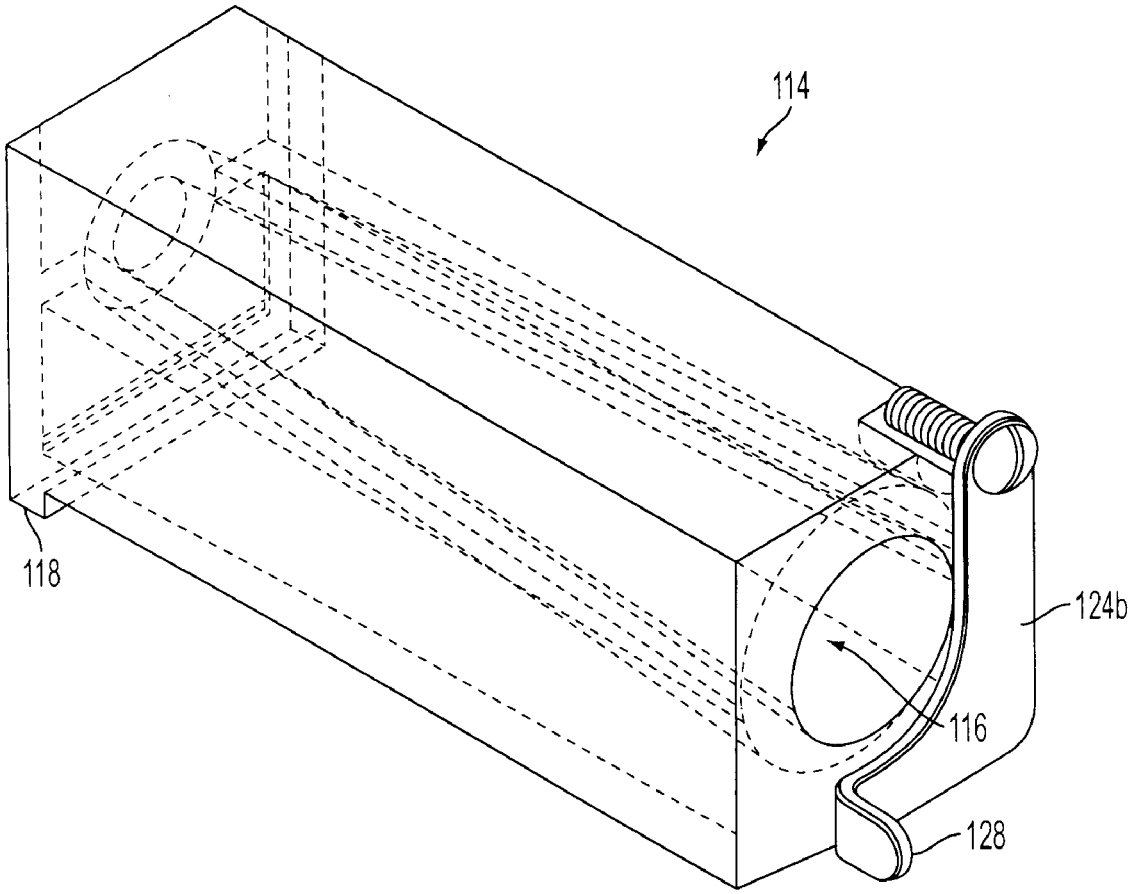
FIG. 21 is a perspective view of the guide member with an alternative retention means.
Figure 22:
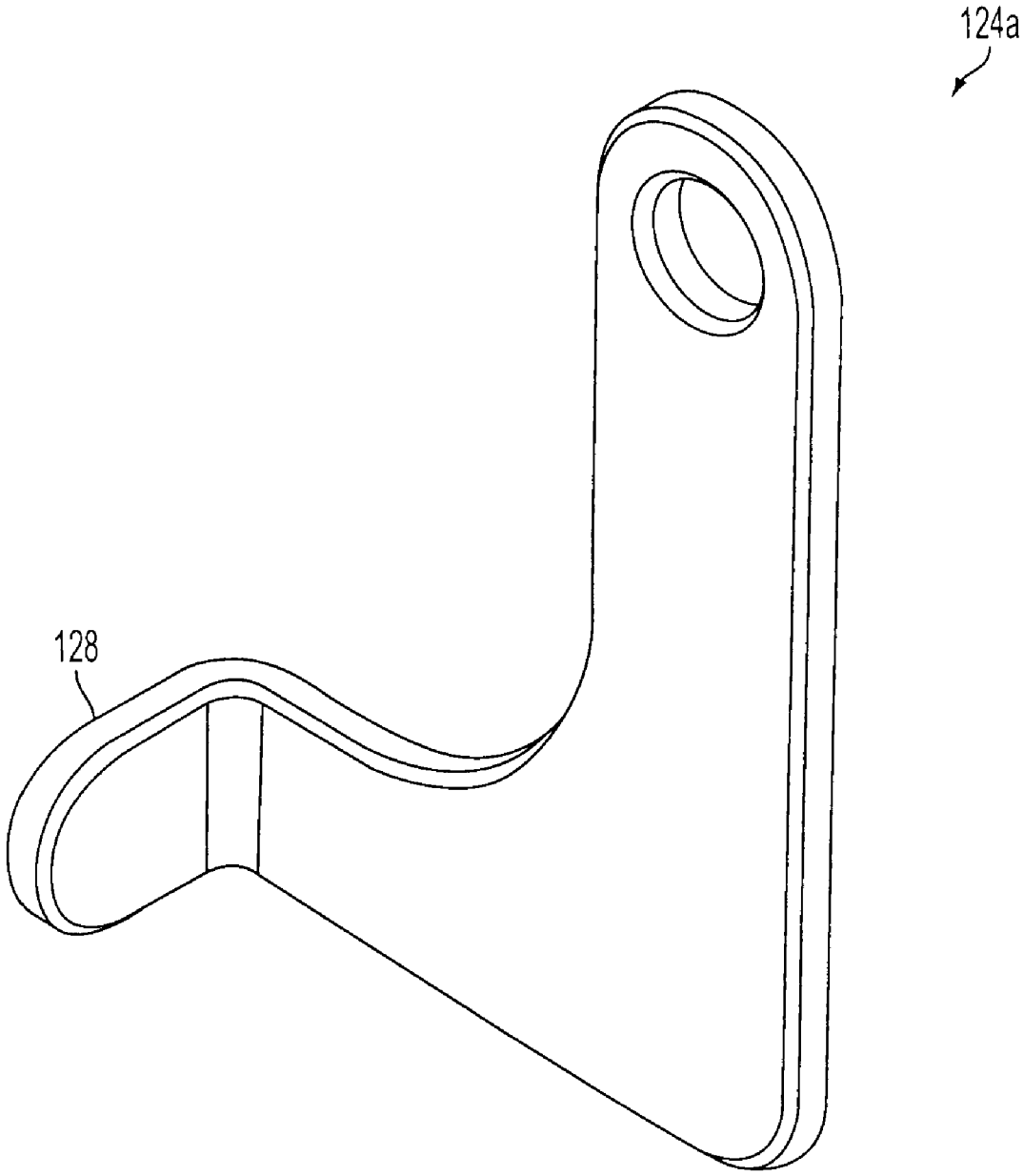
FIG. 22 is a perspective view of the retention means depicted in FIG. 21.

It is envisioned that the syringe well 102 and the member 114 may possess complementary elements for facilitating a more secure fit between the well 102 and member 114. For example, as depicted in FIGS. 16, 18 and 20, the member 114 has a stud 118 complementary to a similarly shaped channel 120 formed in the syringe well 102. The stud 118 and channel 120 may be formed at various locations or positions, including the arrangement depicted in FIGS. 16, 18 and 20, whereby the stud 118 is formed at the end of the member 114 that is adjacent with the wall 106, the stud 118 traversing the shortest length available, and the channel 120 being formed in the syringe well 102 adjacent the wall 106 and below the general plane of the interior of the well 102. However, other positions and arrangements are certainly contemplated and not limited to the one example depicted in the figures. Furthermore, it is contemplated that a plurality of complementary elements (such as teeth and cells) may serve as suitable substitutes for the stud 118 and channel 120 combination disclosed above.

The vial well 104 has an opening (vial well opening) 130 generally positioned at an anterior surface of the guide. The well 104 includes a recess 110 that may be formed in accordance with the various techniques and structures, and equivalents, described above. The well 104 may also include one or more ribs 132, each rib 132 aligned parallel to one another and aligned parallel to an imaginary axis traversing the aperture 108 formed in wall 106. The ribs 132 may be spaced-apart, the space or void defined therebetween accommodating the body of the vial. In this capacity, the ribs 132 slightly raise the vial and prevent unnecessary movement of the vial during use. It is envisioned that the ribs 132 are cooperative with the recess 110 formed adjacent to the wall 106 in securing the vial in a fixed position during extraction of the medication.

The vial well 104 may also include a plurality of slits 134 formed in the lateral regions of the body of the guide 100. As depicted in FIGS. 13-15, by way of example only, the guide 100 generally has the form of a polyhedron with one or more open "faces". The long-sides of the polyhedron include the opened anterior surface, at least one open end (e.g. 112*b*), and walls forming the bound surfaces of the polyhedron (e.g. two-mutually opposed lateral side walls, a posterior wall [hidden from view], and an end wall at the terminal end of the vial well 104). The slits 134 may be formed in the lateral long-side walls to accommodate a movable panel 136. By way of example only, FIG. 13 depicts a vial well 104 having two sets of slits 134, two slits formed in each one of the lateral long-side walls. The most forward slits (relative to wall 106) form a pair, and the most rearward slits form another pair, for example. Thus, the panel 136 may be positioned with the most forward pair of slits, removed and repositioned within the most rearward pair of slits. Additional slits and slit pairs are envisioned. Providing the slits and slit pairs and corresponding panel allows the vial well to accommodate vials that are larger or longer, providing adequate support to the base of the vial during use.

The displaceable cover 138 encloses the syringe well 102 and the vial well 104, and may comprise a variety of configurations and/or shapes. The cover 138 may be attached or coupled to the body of the guide 100 via attachment means, including one or more hinges or hinge substitutes. The cover 138 may also be unattached and free from the guide 100 and coupled to the guide 100 for enclosing the wells 102 and 104 by other means, including the use of temporary adhesive dots, magnets, clamps, impingement teeth, and other suitable substitutes known in the art. The cover 138 may comprise a saddle 140 disposed on the interior side of the cover 138, the saddle 140 configured and arranged to accommodate the general shape of the vial body. By way of example only, and in accordance with the figures, the saddle 140 may comprise a block of material fabricated to have a scallop 142 that engages the vial body. As the cover 138 engages the guide 100, the saddle 140 engages the vial body, impinging the vial body therein. It is envisioned that the recess 110, the optional rib(s) 132 and the saddle 140 (with optional scallop 142) may work cooperatively to immobilize the vial within the vial well 104 during use.

Figure 23:
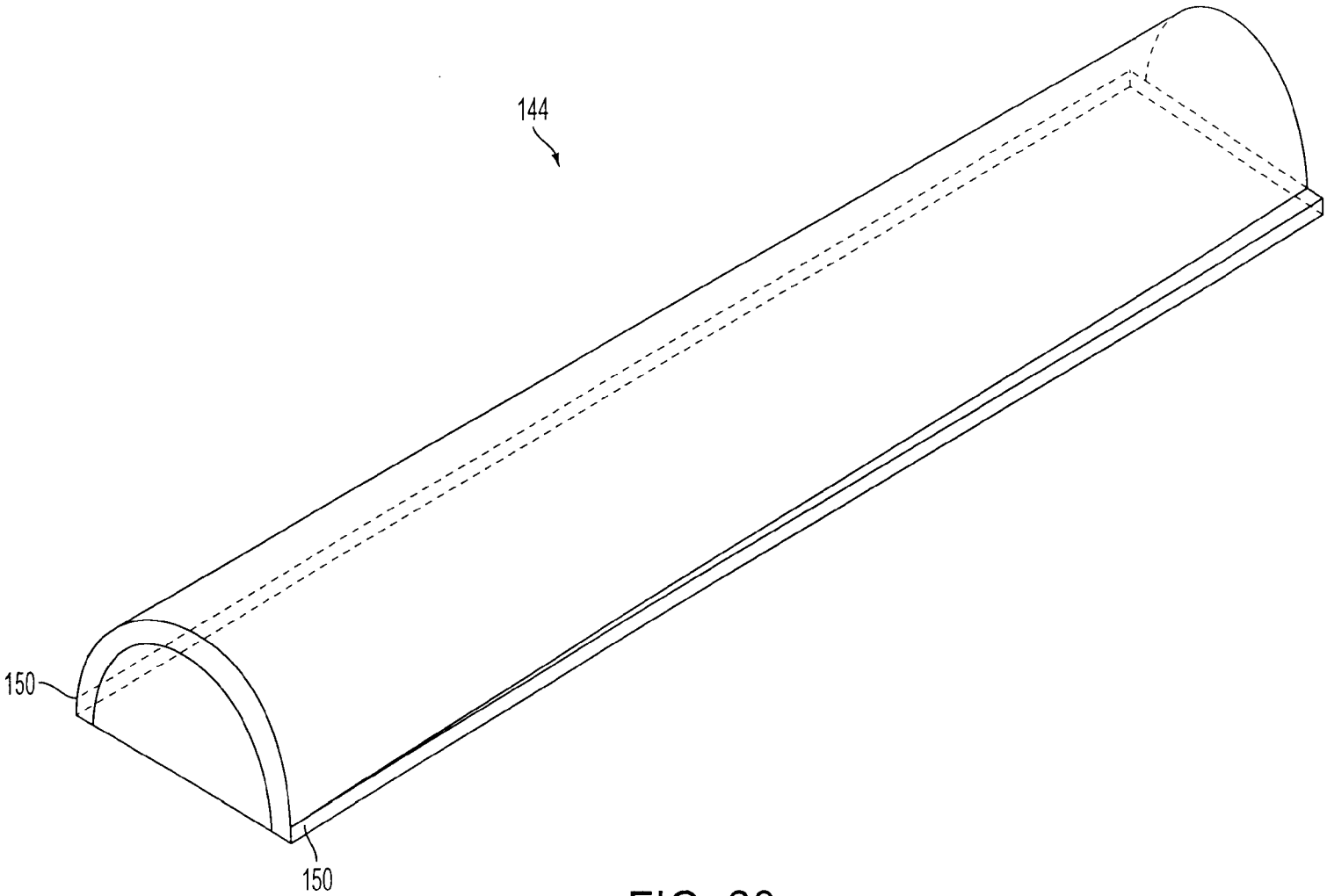
FIG. 23 is a perspective view of one embodiment of a magnifying element.

The cover 138 may further include an integral, or alternatively, a removable magnification element 144. The magnification element 144 enlarges any indicium, indicia or print provided on the syringe and/or the vial, thereby enhancing the ease of use of the guide 100. The magnification element 144 may comprise a variety of shapes and sizes, including a regular polyhedron bar, or a semi-cylindrical bar (as depicted in FIG. 13 and FIG. 23), and other suitable variations. The magnification element 144 may be removable, as depicted in the figures, wherein the element 144 engages and communicates with a track formed in the exterior of the cover 138. As depicted, the track may comprise an elongated L-shaped perimeter 146 that runs along the long-edges of the cover 138. The element 144 may have a complementary lip or protrusion 150 that slides within the space or void 148 defined between the L-shaped perimeter and the backbone of the cover 138. However, it is envisioned that other known means for coupling the element 144 with the cover 138 may be utilized to achieve the same or similar object.

Figure 24:
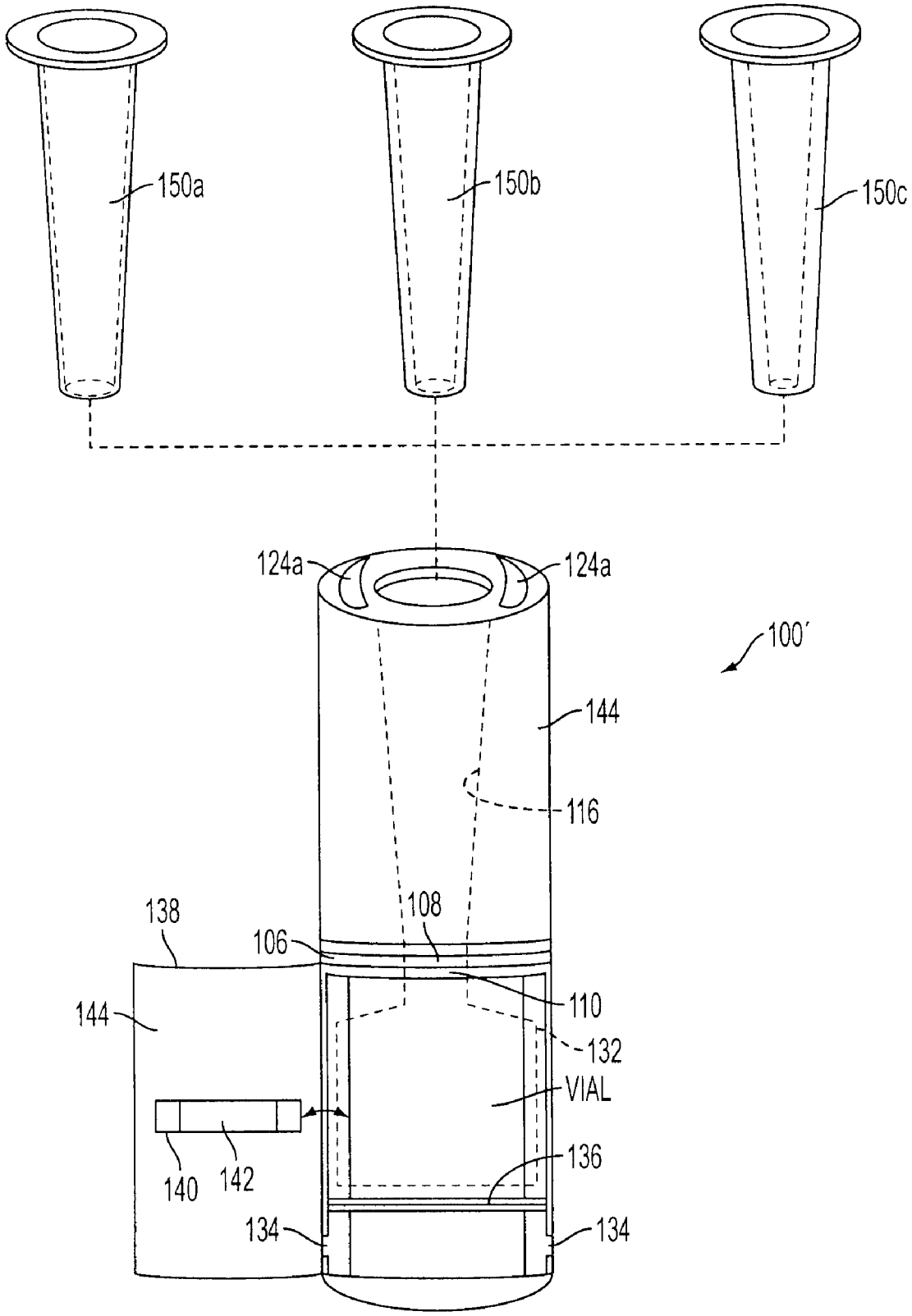
FIG. 24 is an exploded perspective view of another embodiment of the guide, wherein the bore is integral to the body of the guide and comprises multiple inserts to accommodate a variety of syringe sizes or dimensions.

Referring now to FIG. 24, another embodiment is disclosed wherein a guide 100' comprises a body that may be conceptualized as having a syringe area and a vial area separated or segregated by a wall 106. The syringe area having a bore 116 terminating at the wall 106 and generally coextensive with the aperture 108 formed in the wall 106. The syringe area may further include means for retaining the syringe in an immobilized condition, such as the wings 124*a* (as shown) or the arm 124*b* (as depicted in other embodiments). The wall, aperture, bore and retention means bear substantially the same characteristics and functions as the same elements as described in previous embodiments.

The vial area comprises a recess 110 aligned with the aperture 108 and the bore 116, and may include ribs 132, the recess 110 and ribs 132 aiding in the alignment and securement of the vial body within the vial area. The vial area may further include a plurality of slits 134 accommodating a movable panel 136. The vial area may further include a cover or door 138, attached or free, for enclosing the vial area. On the interior surface of the cover or door 138, a saddle 140 may be provided for engaging and impinging the vial body. The saddle 140 may further include a scallop 142 complementary to the vial body. The ribs, slits, panel, cover or door, saddle (with or without scallop) bear substantially the same characteristics and functions as the same elements as described in previous embodiments.

In one embodiment, the bore 116 has the dimension and cross-sectional diameter to accommodate a 3 milliliter (mL) syringe, generally considered one of the larger syringes for self-administration of medication. To enhance the versatility of the guide 100', a plurality of inserts 150*a*, 150*b* and 150*c*, respectively, may be provided. The inserts 150*a*, 150*b*, 150*c* are dimensioned to slidably insert within the bore 116 while reducing the cross-sectional diameter through which the syringe may be inserted through. For example, insert 150*a* may be dimensioned to accommodate a 100 cc syringe, the insert 150*b* may be dimensioned to accommodate a 50 cc syringe, and insert 150*c* may be dimensioned to accommodate a 30 cc syringe. Thus, the user or individual may select the appropriate insert for placement within the bore 116 to properly accommodate and aid in the placement of the syringe therethrough and into communication with the vial.

Figure 25:
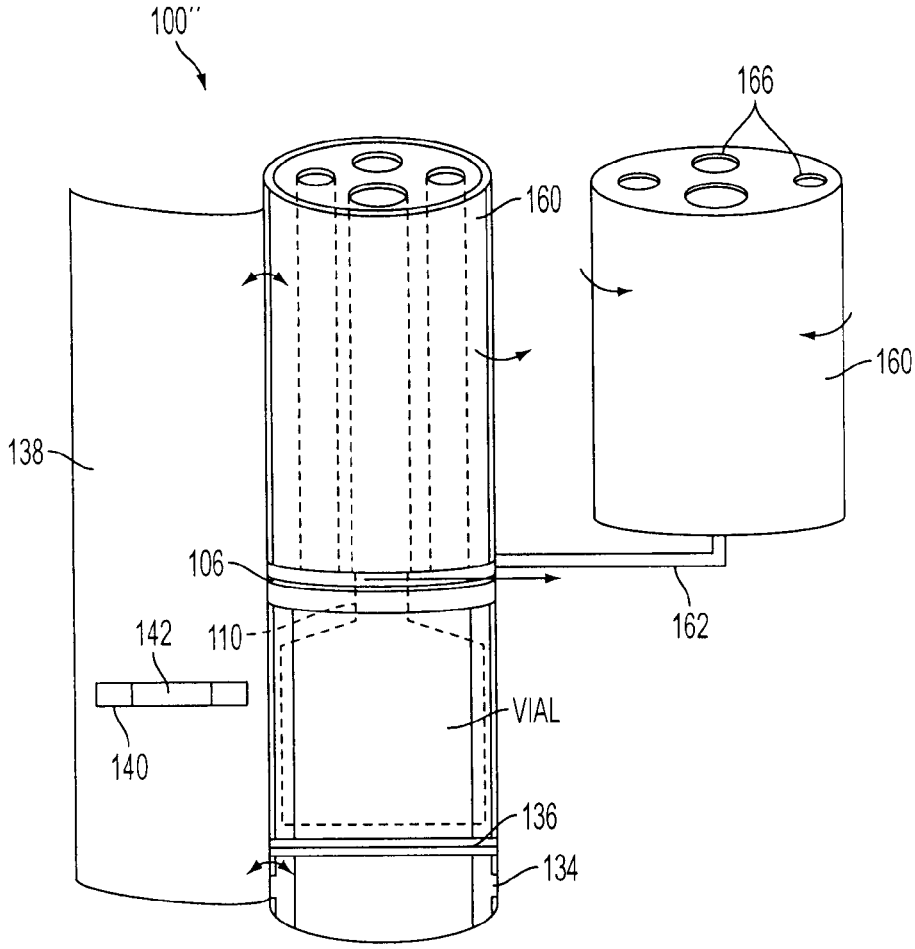
FIG. 25 is an exploded perspective view of another embodiment of the guide, wherein the guide comprises a revolving barrel with a plurality of bores, the barrel is selectively rotatable about a spindle for selecting the appropriate bore size.
Figure 26:
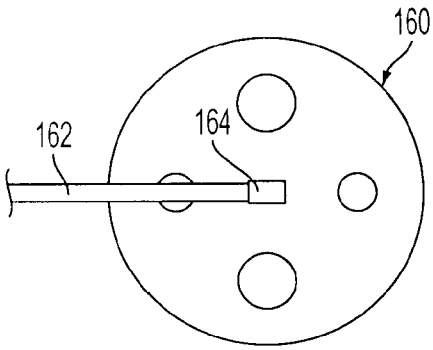
FIG. 26 is an end view of the revolving barrel.
Figure 27:
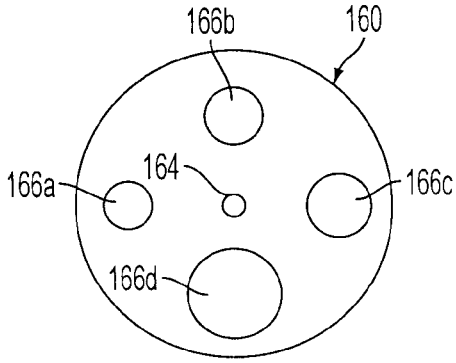
FIG. 27 is an end view of the revolving barrel taken from the opposing end depicted in FIG. 26.

Referring now to FIG. 25 through FIG. 27, another embodiment is disclosed, wherein guide 100" comprises a body having a syringe area and a vial area, wherein each area is enclosed by a cover or door 138 (attached or free). In the syringe area, a revolving barrel 160 is provided, coupled to the syringe area and body via a post 162 and spindle 164 inserted through the revolving barrel 160. The revolving barrel 160 comprises a plurality of bores 166 traversing the longitudinal length thereof, the bores generally accommodating 30 cc, 50 cc, 100 cc and 3 mL syringes, respectively (denoted by 166*a*, 166*b*, 166*c*, and 166*d*, respectively). Thus, when a user needs to select a specific bore to accommodate a specific syringe size, the user will open or remove the cover or door 138 and extend the revolving barrel 160 from the body via the post 162 and rotate the revolving barrel 160 about the spindle 164 until the appropriate bore size is selected. The bores are offset from the center, therefore, it is envisioned that the vial well will accommodate the offset accordingly by positioning of the recess 110, ribs 132 and the saddle 140 (with or without scallop 142) so that the vial is displaced outwardly toward the exterior of the guide 100" and body of the guide.

It is envisioned that the various elements disclosed in this application are capable of a variety of combinations, including those explicitly disclosed in the various embodiments, as well as other envisioned but not explicitly disclosed variations.

What is claimed is:

1. An apparatus for assisting a user in loading a syringe with medication from a medicinal vial, the apparatus comprising:

an elongated guide having a syringe well and a vial well;

a syringe guide member inserted into and removable from the syringe well, the syringe guide member having a bore for receiving and guiding the syringe;

the vial well being adapted to receive a vial, the vial well having a recess supporting the neck of a vial received in said vial well;

a wall separating the syringe well and the vial well, the wall having an aperture formed therethrough providing communication between one end of the bore and a vial received in said vial well;

a displaceable cover enclosing the syringe well and the vial well; and a magnifying element coupled to the cover, said magnifying element magnifying the contents of the syringe well and the vial well.

2. The apparatus of claim 1, wherein said bore has a funnel shape.

3. The apparatus of claim 1, wherein the cover comprises a saddle disposed on the interior side thereof engaging the body of the vial.

4. The apparatus of claim 1 further comprising retention means for retaining and immobilizing the syringe as the syringe plunger is withdrawn to fill the syringe barrel with medication.

5. The apparatus of claim 4, wherein said retention means comprises a pair of wings, each one of the wings spaced-apart from an end of the syringe guide member forming a void, the void receiving and retaining the syringe flange therein.

6. The apparatus of claim 4, wherein said retention means comprises an arm, the arm coupled to an end of the syringe guide member and rotatable to urge the arm into communication with the exterior surface of the syringe barrel.

7. The apparatus of claim 1, wherein the recess aligning the neck of the vial with the aperture and an end of the syringe bore.

8. An apparatus for assisting a user in loading a syringe with medication from a medicinal vial, the apparatus comprising:

an elongated guide having a syringe well and a vial well;

the syringe well having a syringe well opening along a surface of the guide;

a syringe guide member inserted into and removable from the syringe well through the syringe well opening, the syringe guide member having a bore for receiving and guiding the syringe;

the vial well having a vial well opening along an anterior surface of the guide and being adapted to receive a vial through the vial well opening, the vial well having a recess supporting the neck of a vial received in said vial well, the vial well having a removable panel and a plurality of slits, the panel removable from one of the slits for placement within one of the other slits, the panel supporting the base of a vial when a vial is placed within the recess;

a wall separating the syringe well and the vial well, the wall having an aperture formed therethrough providing communication between one end of the bore and a vial received in said vial well;

the recess mutually adjacent with the wall, the recess aligning the neck of a vial received in said vial well with the aperture of the wall;

a displaceable cover enclosing the syringe well and the vial well, the cover having a saddle disposed on the interior side thereof;

and a magnifying element coupled to the cover, the magnifying element magnifying the contents of the syringe well and the vial well when the cover is placed over the syringe well and the vial well.

9. The apparatus of claim 8 further comprising:

a channel formed in the syringe well; and a stud formed on the syringe guide member, the stud complementary to the channel;

wherein the stud and channel are mutually coupled to further couple the syringe guide member with the syringe well.

10. The apparatus of claim 8, wherein the syringe guide member further comprises retention means for retaining and immobilizing the syringe as the syringe plunger is withdrawn to fill the syringe barrel with medication.

11. The apparatus of claim 10, wherein said retention means comprises a pair of wings, each one of the wings spaced-apart from an end of the syringe guide member forming a void, the void receiving and retaining the syringe flange therein.

12. The apparatus of claim 10, wherein said retention means comprises an arm, the arm coupled to an end of the syringe guide member and rotatable to urge the arm into communication with the exterior surface of the syringe barrel.

13. The apparatus of claim 8, wherein the bore comprises a funnel shape.

14. The apparatus of claim 8, wherein the recess comprises a curvilinear form, the recess supporting the neck of the vial.

15. The apparatus of claim 8, wherein the cover comprises a track for the magnifying element, the magnifying element slidably inserted and removed therefrom.

16. The apparatus of claim 8, wherein the magnifying element comprises a semi-cylindrical shape.

* * * * *